United States Patent [19]

Warren et al.

[11] 4,323,352

[45] Apr. 6, 1982

[54] CERF CYCLE

[76] Inventors: William Warren, c/o George Spector, 3615 Woolworth Bldg., 233 Broadway; George Spector, 3615 Woolworth Bldg., 233 Broadway, both of New York, N.Y. 10007

[21] Appl. No.: 111,880

[22] Filed: Jan. 14, 1980

[51] Int. Cl.[3] ..... F16H 37/06

[52] U.S. Cl. ..... 440/27; 74/665 GB; 74/417; 114/61; 440/31; 440/63

[58] Field of Search ..... 440/26, 27, 31, 75, 440/53, 63; 280/289 S; 114/61, 151; 9/1.5; 74/665 F, 665 GB, 417

[56] References Cited

U.S. PATENT DOCUMENTS

| | | | |
|---|---|---|---|
| D. 151,382 | 10/1948 | Melton | 440/27 X |
| 3,031,692 | 5/1962 | Riek | 440/27 X |
| 3,487,805 | 1/1970 | Satterthwaite et al. | 114/151 X |
| 3,517,633 | 6/1970 | Wanzer | 114/151 |
| 4,089,556 | 5/1978 | Stobar | 280/289 S X |

FOREIGN PATENT DOCUMENTS

| | | | |
|---|---|---|---|
| 444463 | 1/1949 | Italy | 9/1.5 |
| 184420 | 8/1922 | United Kingdom | 440/31 |

*Primary Examiner*—Joseph F. Peters, Jr.
*Assistant Examiner*—Donald W. Underwood

[57] ABSTRACT

A craft for travel upon a water surface, the craft including a frame mounted upon two spaced apart pontoons, a windshield, a two passenger seat, and a foot powered mechanism mounted on the frame, the mechanism including propellers mounted on foreward-rearwardly and upon sidewardly shafts so that the craft can travel in any direct or any combination of directions.

2 Claims, 2 Drawing Figures

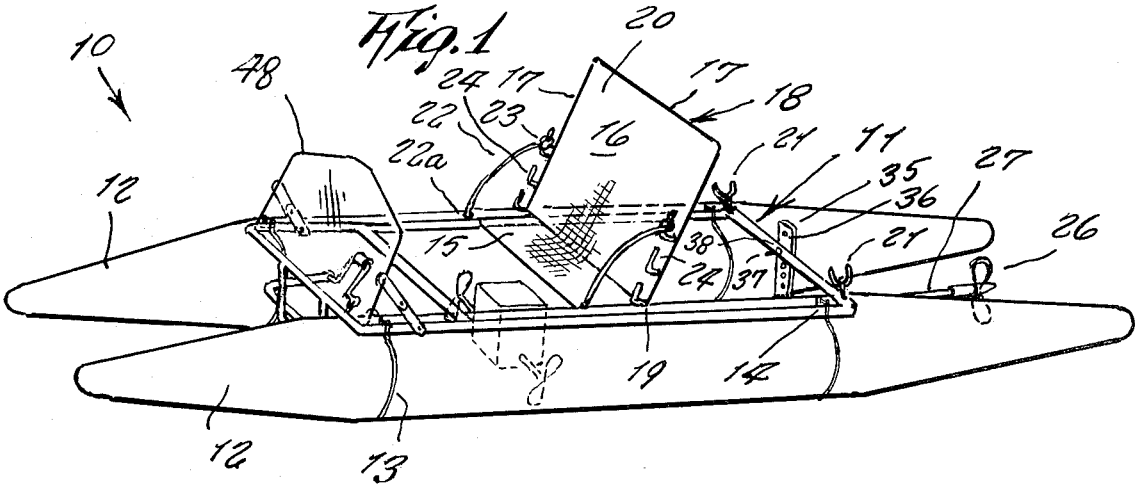
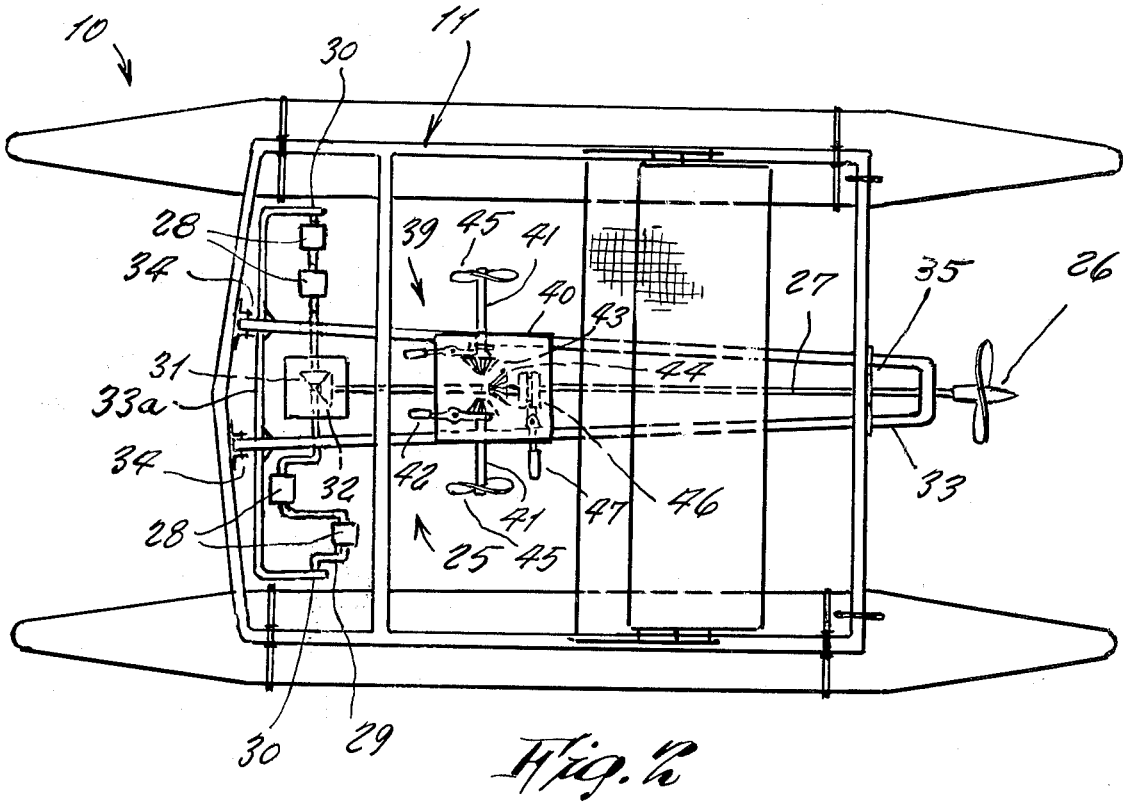
Fig. 2

CERF CYCLE

This invention relates generally to pleasure craft for travel upon water.

A principal object of the present invention is to provide a cerf cycle powered by foot peddling of riders thereupon and which can travel in any direction including directly sidewardly so to be easy to land alongside a dock in order to get on or off.

Another object is to provide a cerf cycle which allows propellers to be raised when the craft is being beached so as to not become damaged on a ground or rocks.

Still another object is to provide a cerf cycle having a seat that is convertible into a large horizontal pad so persons can lay thereupon for sun bathing or relaxing while aboard.

FIG. 1 is a perspective view of the craft.

FIG. 2 is a top view thereof.

Referring now to the drawing in greater detail, the reference numeral 10 represents a cerf cycle according to the present invention, wherein there is a frame 11, made of light weight angle-iron, and which is mounted upon a pair of waterproof, parallel, spaced apart pontoons 12 by means of four steel bands 13 looped around the pontoons and the band end being drawn together by a bolt 14 extending over a top of each corner of the frame.

A seat 15, carried on the frame comprises a canvas sheet 16 with rolled over edges so to be threaded on tubular aluminum rods 17 of a rectangular framework 18, the seat being sufficiently longthwartwise so as to allow seating of two persons alongside each other.

The seat framework includes a hinge 19 on opposite sides so that a back rest portion 20 thereof may be pivoted between the upwardly position, shown in FIG. 1, to a horizontal position rearwardly where the framework is grasped in Y-shaped brackets 21 mounted upon the frame 11, so that the seat is thus suitable for persons to lay down thereupon for sunbathing or just relaxing while upon the cerf cycle.

When the back rest portion is tilted upwardly in any of several different angles, it is retained in the selected angle position by means of a pair of armrests 22 pivoted at one end about a pivot pin **22*a* held in the frame 11, while an opposite end of the arm rest provided with a loop 23 which is dropped over one of several hooks 24 formed along each opposite side rod 17** of the framework.

The cerf cycle is provided with a mechanism 25 for travel upon the water. The mechanism includes a propeller 26 affixed on a propeller shaft 27 which is rotated by footpower of the two persons peddling their feet against peddles 28 on a crankshaft 29 supported rotatably in bearings 30 of a bar **33*a* welded on member 33. A level gear 31 on the crank shaft engages a level gear 32** on the propeller shaft.

In order that the propeller is not damaged by scraping against ground or rocks when the craft is pulled up on a beach, the propeller can be raised upwardly at such time, by means of the U-shaped frame member 33 supporting a rear end of the propeller shaft therethrough being upwardly pivotable about hinges 34 at the forward ends of member 33. The member 33 is secured in any degree of raised or lowered position by means of a vertical bar 35 rigidly affixed to a rear portion of member 33 having a row of holes 36 therethrough for selectively receiving a pin or bolt 37 received also through a hole 38 in the frame 11.

The craft includes a novel steering mechanism 39 that includes a gear box 40 mounted upon the frame member 33 and which supports two sidewardly slidable shafts 41 slidably operated by hand levers 42 so that a level gear 43 on each shaft 41 can selectively engage a level gear 44 on the propeller shaft 27, and thereby permit a propeller 45 on each shaft 41 to pull the craft in a sideward direction at a same time while the propeller 26 pulls the craft either ahead or backwards.

A clutch 46 along a rear portion of the propeller shaft 27, operative by hand lever 47 allows disengagement of power to propeller 26 all together, if so wished, so that the craft can then move only straight sidewardly, without forward or rear travel, so to be ideal when coming alongside a dock.

A windshield 48 is mounted on frame 11.

What is claimed:

1. A cerf cycle craft for travel upon a water surface, comprising in combination, an angle iron frame mounted upon a pair of spaced apart pontoons, a windshield, a seat and a foot powered drive mechanism mounted on said frame, said mechanism including means for moving said craft in either a directly forward, rearward, either side or in intermediate directions therebetween wherein said mechanism includes a first propeller along a first shaft extending longitudinally of said craft, and a pair of second propellers each of which is on a transverse shaft, and clutch means for selective engagement of said shafts with a crankshaft fitted with foot pedals.

2. The combination as set forth in claim 1 wherein said shafts are carried upon a U-shaped bar member pivotally supported on said frame, so to selectively raise or lower said propellers.

* * * * *